US011841644B2

(12) United States Patent
Kawamura et al.

(10) Patent No.: US 11,841,644 B2
(45) Date of Patent: Dec. 12, 2023

(54) TONER CARTRIDGE AND IMAGE FORMING APPARATUS INCLUDING A SCREW TO CONVEY TONER IN THE CARTRIDGE, AN ELASTIC MEMBER TO LOOSEN THE TONER, AND A MEANS TO DISCHARGE TONER TOGETHER WITH AIR TO THE OUTSIDE OF THE CARTRIDGE

(71) Applicant: CANON KABUSHIKI KAISHA, Tokyo (JP)

(72) Inventors: Tomofumi Kawamura, Shizuoka (JP); Masato Tanabe, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/821,747

(22) Filed: Aug. 23, 2022

(65) Prior Publication Data

US 2022/0404739 A1 Dec. 22, 2022

Related U.S. Application Data

(63) Continuation of application No. 17/327,560, filed on May 21, 2021, now Pat. No. 11,442,379.

(30) Foreign Application Priority Data

May 28, 2020 (JP) ..... 2020-093337

(51) Int. Cl.
*G03G 15/08* (2006.01)

(52) U.S. Cl.
CPC ..... *G03G 15/0887* (2013.01); *G03G 15/0822* (2013.01); *G03G 15/0865* (2013.01); *G03G 15/0874* (2013.01); *G03G 15/0879* (2013.01); *G03G 2215/066* (2013.01)

(58) Field of Classification Search
CPC ..... G03G 15/0887; G03G 15/0822; G03G 15/0865; G03G 15/0874; G03G 15/0879; G03G 2215/066
See application file for complete search history.

(56) References Cited

U.S. PATENT DOCUMENTS 11,442,379 B2 * 9/2022 Kawamura ..... G03G 15/0887

FOREIGN PATENT DOCUMENTS

AU 2008200459 B2 * 6/2010 ..... G03G 15/0875
JP 5623109 B2 * 11/2014 ..... G03G 15/08

* cited by examiner

*Primary Examiner* — Joseph S Wong
(74) *Attorney, Agent, or Firm* — Canon U.S.A., Inc. I.P. Division

(57) ABSTRACT

A cartridge includes a casing including a toner storage chamber storing toner and a toner discharge chamber having an outlet, a conveyance member conveying the toner from the toner storage chamber to the toner discharge chamber, an action member attached to the conveyance member and repeating an action of shifting between an entering state of entering the outlet and a retraction state of retracting from the outlet, and a pump expanding and contracting to be shifted between a first state and a second state in which the internal space is smaller in volume than in the first state, the pump putting air into the toner discharge chamber by being shifted from the first state to the second state, thereby discharging the toner from the toner discharge chamber through the outlet, and the pump taking in air by being shifted from the second state to the first state.

19 Claims, 11 Drawing Sheets

TONER CARTRIDGE AND IMAGE FORMING APPARATUS INCLUDING A SCREW TO CONVEY TONER IN THE CARTRIDGE, AN ELASTIC MEMBER TO LOOSEN THE TONER, AND A MEANS TO DISCHARGE TONER TOGETHER WITH AIR TO THE OUTSIDE OF THE CARTRIDGE

CROSS-REFERENCE TO RELATED APPLICATIONS

The present application is a continuation of U.S. patent application Ser. No. 17/327,560, filed on May 21, 2021, which claims priority from Japanese Patent Application No. 2020-093337 filed May 28, 2020, which are hereby incorporated by reference herein in their entireties.

BACKGROUND

Field of the Disclosure

The present disclosure relates to an image forming apparatus used to form images on recording media, and toner cartridges used in the image forming apparatus.

Description of the Related Art

There is a conventional configuration of an electrophotographic image forming apparatus which includes a developer supply container containing toner which is removably mounted in the main body of the image forming apparatus to supply the toner (developer) to be consumed in image formation.

Japanese Patent No. 5623109 discusses a method of supplying toner from a developer supply container to the main body of an image forming apparatus, using a pump in the developer supply container.

SUMMARY

According to an aspect of the present disclosure, a cartridge includes a casing, the casing including a toner storage chamber storing toner, and a toner discharge chamber having an outlet through which the toner is discharged to outside of the cartridge, a conveyance member configured to rotate and convey the toner from the toner storage chamber to the toner discharge chamber, an action member attached to the conveyance member and configured to rotate with the conveyance member, the action member being configured to repeat action of shifting between an entering state in which the action member enters the outlet and a retraction state in which the action member retracts from the outlet, by rotation of the conveyance member, and a pump having an internal space, the pump being configured to expand and contract to be shifted between a first state and a second state in which the internal space is smaller in volume than the internal space in the first state, the pump being configured to put air of the internal space into the toner discharge chamber by being shifted from the first state to the second state, thereby discharging the toner from the toner discharge chamber to outside of the cartridge through the outlet, the pump being configured to take air into the internal space by being shifted from the second state to the first state.

DESCRIPTION OF THE EMBODIMENTS

Some exemplary embodiments will be described below with reference to the drawings. The dimensions, materials, shapes, relative positions, and the like of components described in the exemplary embodiments are changeable as appropriate depending on the configuration and various conditions of an apparatus to which the present disclosure is applied, and are not intended to limit the scope of the disclosure to the following exemplary embodiments.

<Overall Configuration of Image Forming Apparatus 100>

Figure 2:
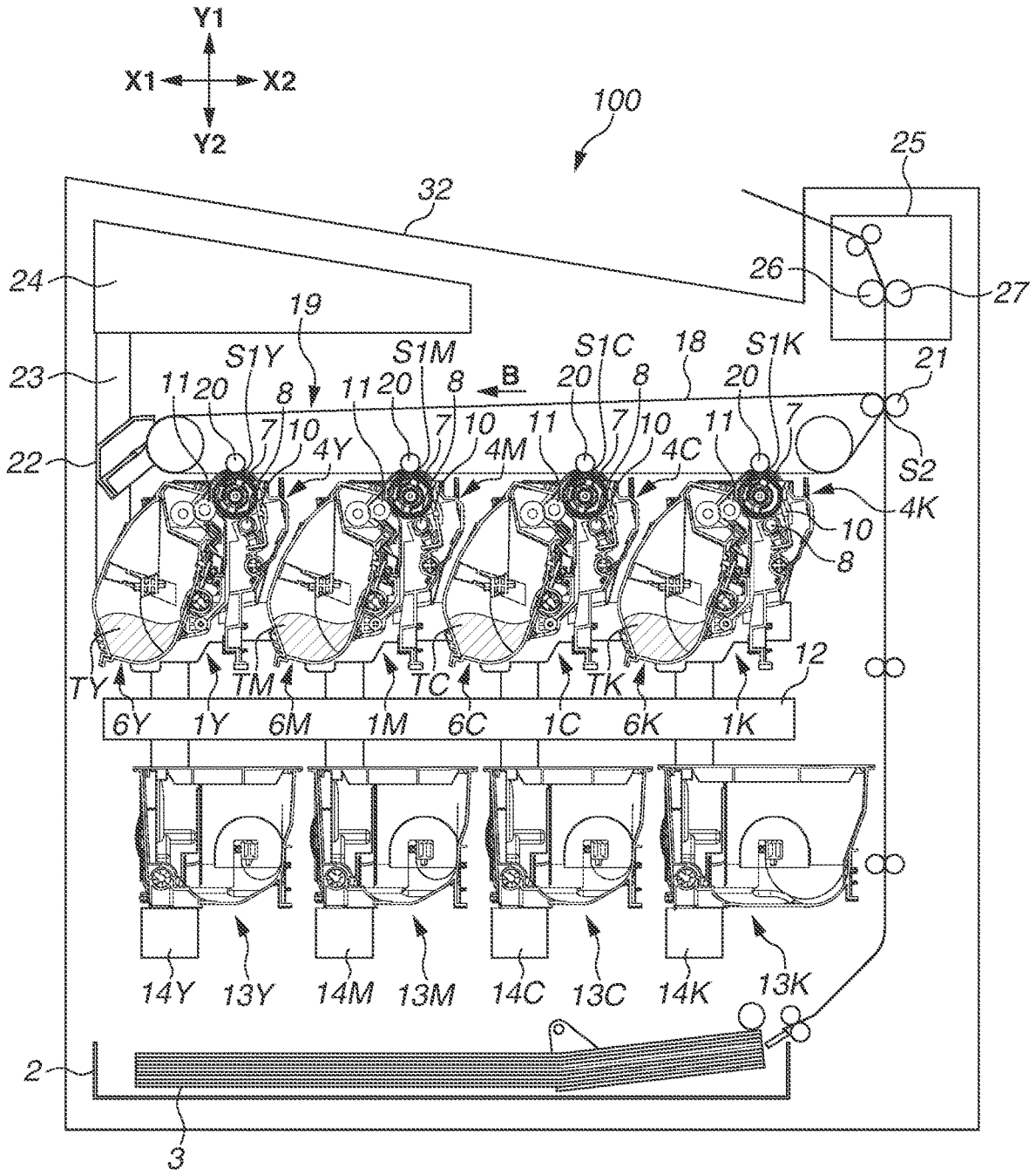
FIG. 2 is a schematic cross-sectional view of an electrophotographic image forming apparatus.

An overall configuration of an electrophotographic image forming apparatus 100 (hereinafter, the image forming apparatus 100) according to an exemplary embodiment will be described with reference to FIG. 2. FIG. 2 is a schematic view of the image forming apparatus 100 according to the present exemplary embodiment. In the present exemplary embodiment, process cartridges 1Y, 1M, 1C, and 1K and toner cartridges (toner supply devices) 13Y, 13M, 13C, and 13K are removably mounted in the main body of the image forming apparatus 100. In the following description, the configuration of the image forming apparatus 100 excluding the process cartridges 1Y, 1M, 1C, and 1K and the toner cartridges 13Y, 13M, 13C, and 13K may be referred to as the main body (apparatus main body) of the image forming apparatus 100.

In the present exemplary embodiment, the process cartridges 1Y, 1M, 1C, and 1K serving as four image forming units are substantially the same in terms of configuration and operation, except that the colors of images to be formed are different. The toner cartridges 13Y, 13M, 13C, and 13K are also substantially the same in terms of configuration and operation, except that the colors of developers T (hereinafter, the toner) stored therein are different. In the following description, indexes Y, M, C, and K may thus be omitted as long as no distinction from each other is made. Here, the indexes Y, M, C, and K of the reference numerals represent four colors yellow, magenta, cyan, and black, respectively.

As illustrated in FIG. 2, the process cartridges 1 are horizontally disposed side by side. The process cartridges 1 each include a cleaning unit 4 and a developing unit 6. The cleaning unit 4 includes a photosensitive drum 7 serving as an image bearing member, a charging roller 8 serving as a charging device for uniformly charging the surface of the photosensitive drum 7, and a cleaning blade 10 serving as a cleaning member. The developing unit 6 contains a developing roller 11 and toner, and develops an electrostatic latent image on the photosensitive drum 7. The cleaning unit 4 and the developing unit 6 are supported to be swingable relative to each other. The process cartridge 1Y stores toner of yellow (Y) in the developing unit 6, the process cartridge 1M stores toner of magenta (M), the process cartridge 1C stores toner of cyan (C), and the process cartridge 1K stores toner of black (K).

The process cartridges 1 are removably mounted in the main body of the image forming apparatus 100, via mounting guides (not illustrated) in the main body of the image forming apparatus 100 and mounting members such as positioning members (not illustrated). Further, a scanner unit 12 for forming electrostatic latent images is under the process cartridges 1. Furthermore, a waste toner conveyance unit 23 is behind the process cartridges 1 (downstream in the mounting direction of the process cartridges 1) in the image forming apparatus 100.

The toner cartridges 13 are horizontally disposed side by side, below in the process cartridges 1 in the gravity direction, in the order corresponding to the colors of toner stored in the process cartridges 1. The toner cartridges 13 serving as the toner supply devices may hereinafter be simply referred to as the cartridge 13. The upward direction opposite the gravity direction and the gravity direction may hereinafter be simply referred to as upward and downward, respectively.

The cartridge 13Y stores toner of yellow (Y), the cartridge 13M stores toner of magenta (M), the cartridge 13C stores toner of cyan (C), and the cartridge 13K stores toner of black (K). Each of the cartridges 13 supplies its toner to the process cartridge 1 storing toner of the same color.

The cartridges 13 perform toner-supply operation when an insufficient amounts of toner in the process cartridge 1 are detected by remaining amount detectors (not illustrated) in the main body of the image forming apparatus 100. The cartridges 13 are removably mounted in the image forming apparatus 100, via mounting guides (not illustrated) in the main body of the image forming apparatus 100 and mounting members such as positioning members (not illustrated). The process cartridges 1 and the cartridges 13 will be described in detail below.

A toner conveyance device 14 for conveying toner from the corresponding cartridge 13 to the corresponding process cartridge 1 is under the corresponding cartridge 13 in the main body of the image forming apparatus 100. More specifically, each of the toner conveyance devices 14 conveys the toner received from the corresponding cartridge 13 upward, and supplies the toner to the corresponding developing unit 6. Each toner conveyance device 14 has a passage for conveying toner and a screw in the passage. Toner is conveyed upward by the rotation of this screw, through the passage of each toner conveyance device 14.

An intermediate transfer unit 19 serving as an intermediate transfer member is disposed over the process cartridges 1. The intermediate transfer unit 19 is substantially horizontal to the bottom surface of the image forming apparatus 100, with primary transfer portions S1 placed downward in the intermediate transfer unit. An intermediate transfer belt 18 facing the photosensitive drums 7 is a rotatable endless belt, and is stretched by a plurality of stretching rollers. On the inner surface of the intermediate transfer belt 18, primary transfer rollers 20 serving as primary transfer members are at positions for forming the primary transfer portions S1 with the photosensitive drums 7 via the intermediate transfer belt 18 lying therebetween. Further, a secondary transfer roller 21 serving as a secondary transfer member is in contact with the intermediate transfer belt 18, and forms a secondary transfer portion S2 with an opposed roller via the intermediate transfer belt 18 lying therebetween. Furthermore, a belt cleaning unit 22 is opposite the process cartridges 1 remote from the secondary transfer portion S2, in the right-left direction substantially parallel to the bottom surface of the apparatus main body and orthogonal to the axial direction of the secondary transfer roller 21.

A fixing unit 25 is further above the intermediate transfer unit 19. The fixing unit 25 includes a heating unit 26 and a pressure roller 27 in pressure contact with the heating unit 26. Further, a discharge tray 32 is at the top surface of the apparatus main body, and a waste toner collection container 24 is between the discharge tray 32 and the intermediate transfer unit 19. Furthermore, a sheet feed tray 2 for storing recording media 3 is at the lowermost in the apparatus main body.

<Image Forming Process>

Figure 3:
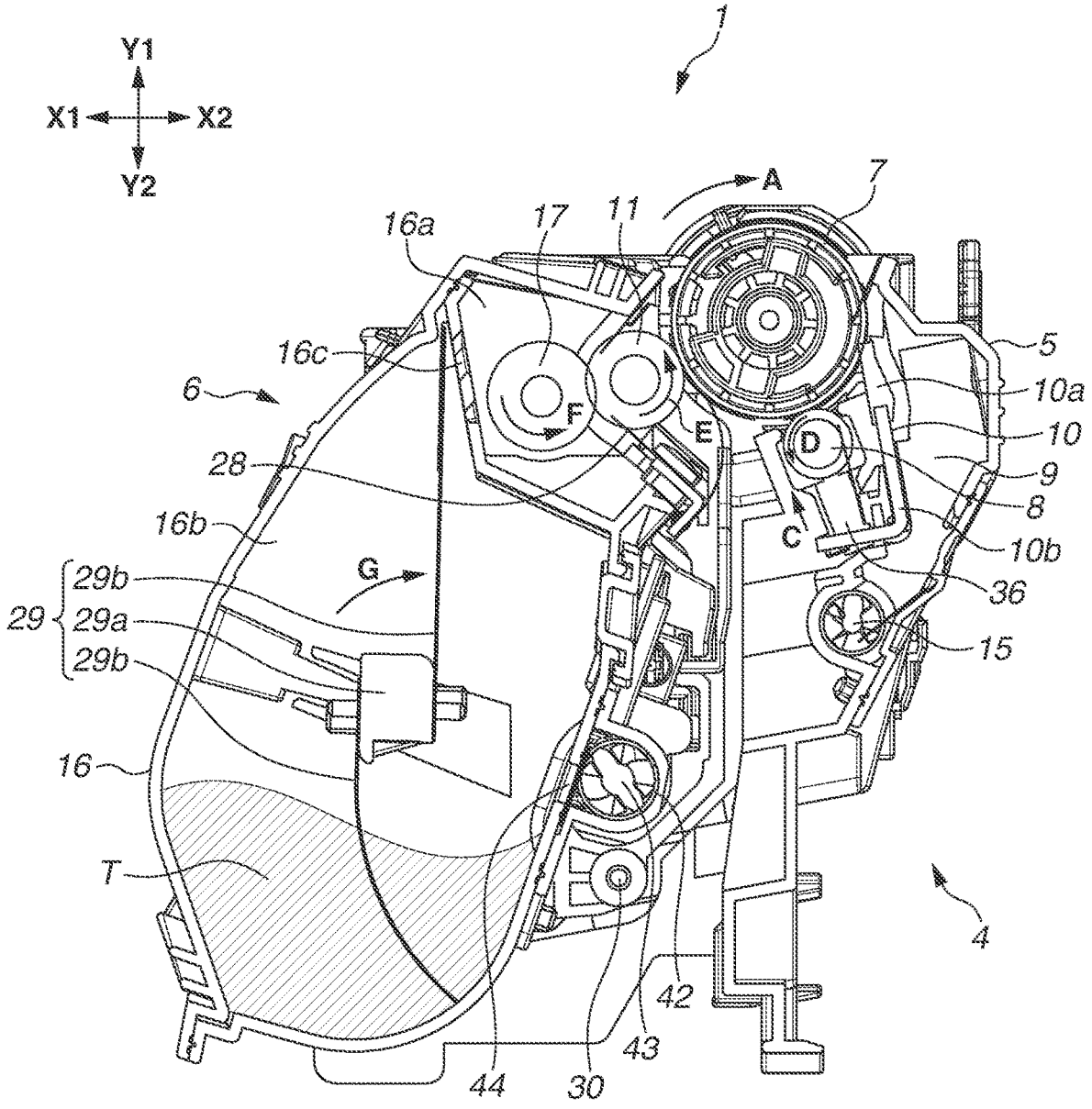
FIG. 3 illustrates a principal section of a process cartridge.

Next, an image forming operation in the image forming apparatus 100 will be described with reference to FIGS. 2 and 3. FIG. 3 is an enlarged schematic cross-sectional view of a process cartridge 1 in the present exemplary embodiment.

As illustrated in FIG. 3, the photosensitive drum 7 is driven to rotate in the direction indicated by an arrow A at a predetermined speed in image formation. The intermediate transfer belt 18 is driven to rotate in the direction indicated by an arrow B in FIG. 2 (in the forward direction with respect to the rotation of the photosensitive drum 7).

First, the surface of the photosensitive drum 7 is uniformly charged by the charging roller 8 as the photosensitive drum 7 rotates. Next, the charged surface of the photosensitive drum 7 is scan-exposed by laser beams emitted from the scanner unit 12, forming an electrostatic latent image based on image information on the photosensitive drum 7. The electrostatic latent image on the photosensitive drum 7 is developed in a toner image by the developing unit 6. In this process, the developing unit 6 is urged toward the photosensitive drum 7 by a development pressure unit (not illustrated) in the apparatus main body. Subsequently, the toner image on the photosensitive drum 7 is primarily transferred from the photosensitive drum 7 onto the intermediate transfer belt 18 by the corresponding primary transfer roller 20 with a predetermined voltage applied thereto, at the primary transfer portion S1.

Here, in forming a full color image, the above-described processes are sequentially performed at the primary transfer portions S1Y, S1M, S1C, and S1K, so that the toner images of the respective colors are superimposed on the intermediate transfer belt 18.

Each of the recording media 3 stored in the sheet feed tray 2 is fed at a predetermined control timing, and conveyed to the secondary transfer portion S2 in synchronization with the movement of the intermediate transfer belt 18. Subsequently, at the secondary transfer portion S2, a predetermined voltage is applied to the secondary transfer roller 21 in contact with the recording medium 3 on the intermediate transfer belt 18, so that the toner images of the four colors on the intermediate transfer belt 18 are collectively transferred onto the recording medium 3.

Afterward, the recording medium 3 with the toner images thereon is conveyed to the fixing unit 25. The recording medium 3 is heated and pressed in the fixing unit 25, so that the toner images are fixed to the recording medium 3. The recording medium 3 after the fixing is then conveyed onto the discharge tray 32, which completes the image forming operation.

The primary-transfer residual toner (waste toner) remaining on the photosensitive drum 7 after the primary transfer to the intermediate transfer belt 18 is removed from the surface of the photosensitive drum 7 with the cleaning blade 10. Further, the secondary-transfer residual toner (waste toner) remaining on the intermediate transfer belt 18 after the secondary transfer to the recording medium 3 is removed from the surface of the intermediate transfer belt 18 with the belt cleaning unit 22. The waste toner removed with the cleaning blade 10 and the belt cleaning unit 22 is conveyed by the waste toner conveyance unit 23 in the apparatus main body, and stored in the waste toner collection container 24. The image forming apparatus 100 can form a single color image or multicolor image, using one or a few (not all) of the image forming units.

<Process Cartridge>

Figure 4:
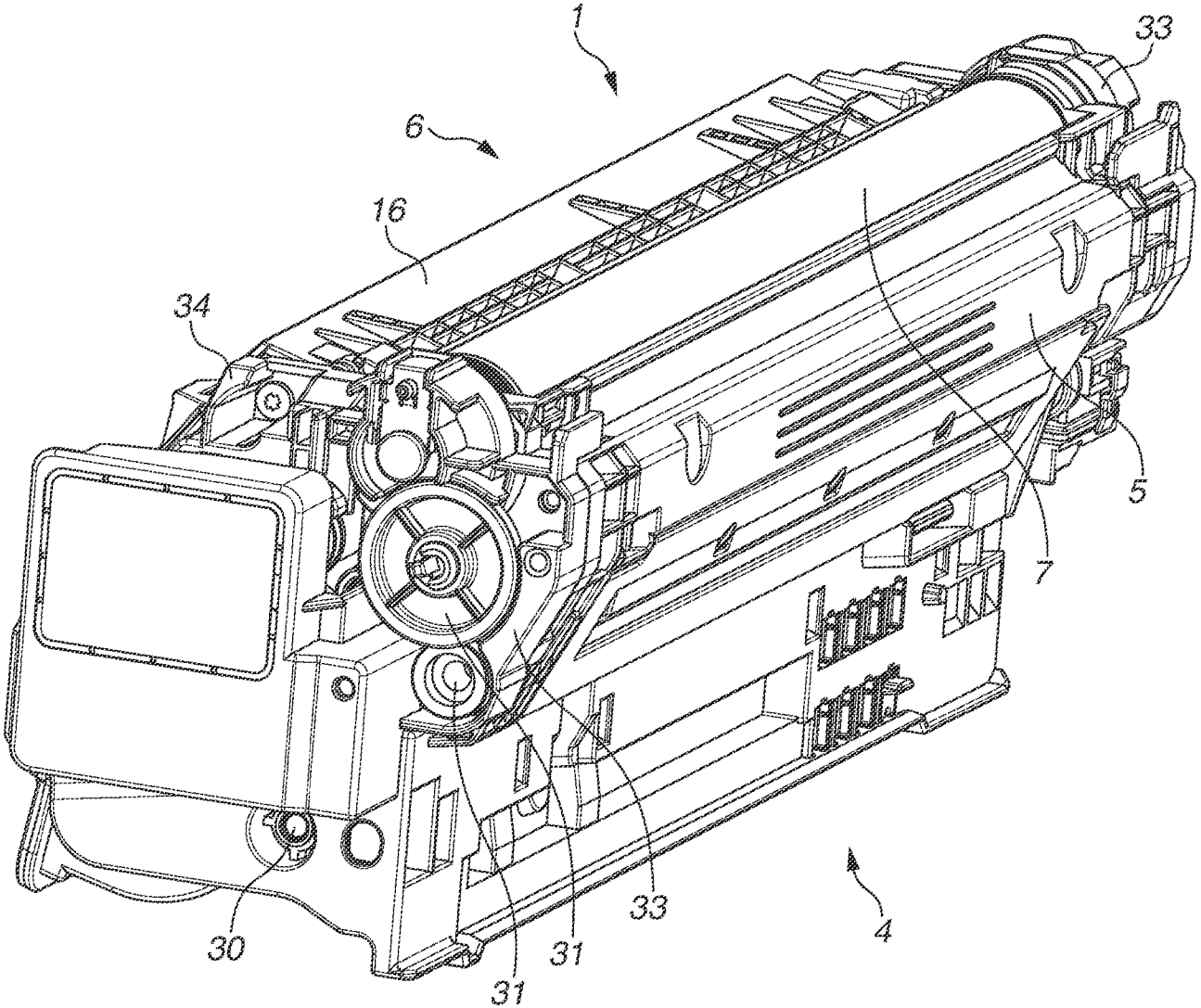
FIG. 4 is an overall perspective view of the process cartridge viewed from front.
Figure 5A:
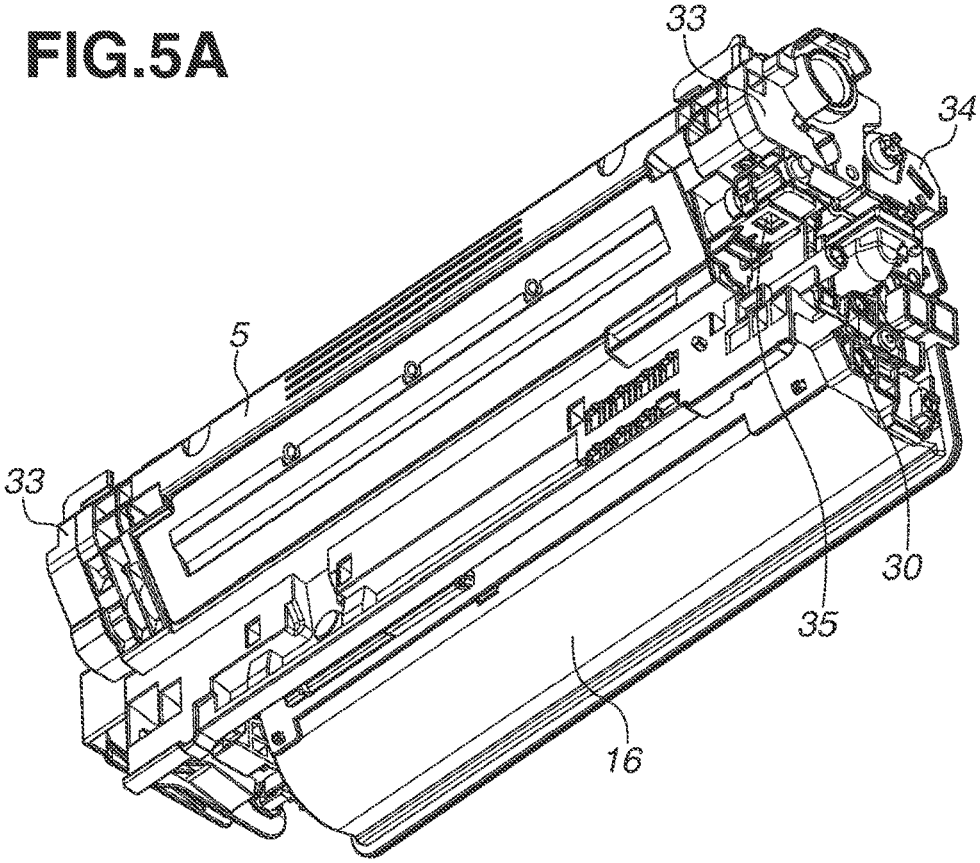
FIGS. 5A and 5B are overall perspective views of the process cartridge viewed from rear.
Figure 5B:
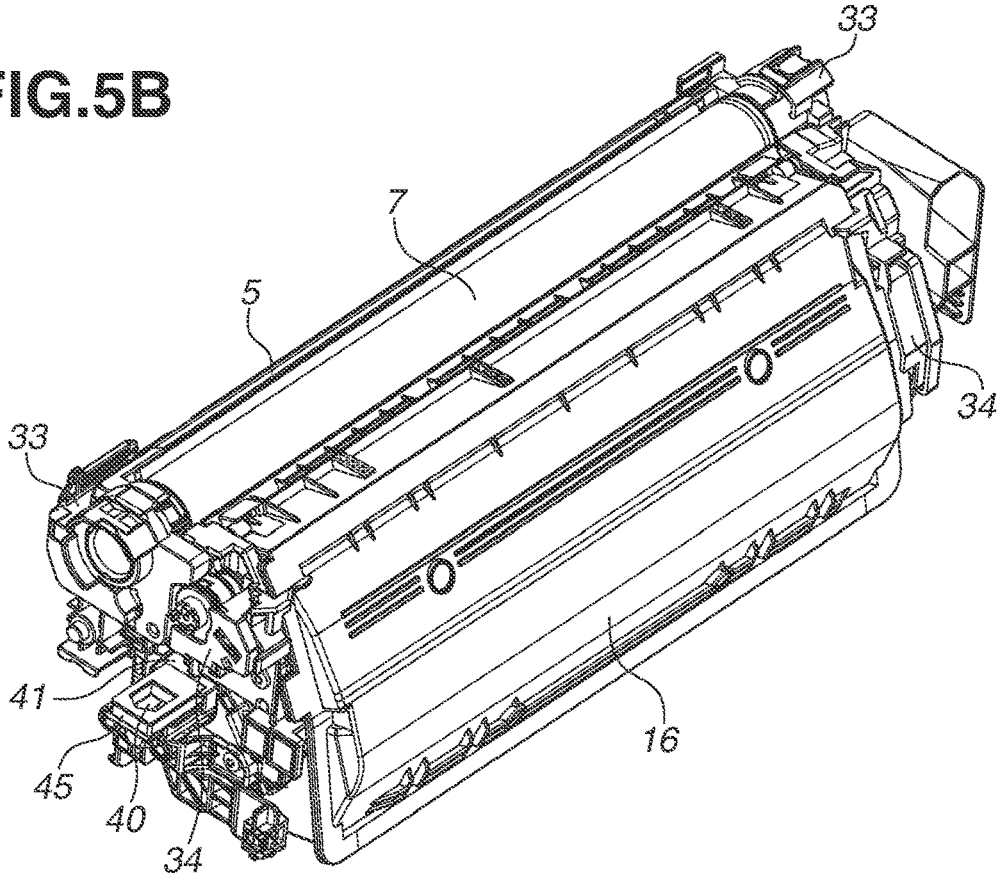

Next, an overall configuration of a process cartridge 1 mounted in the main body of the image forming apparatus 100 according to the present exemplary embodiment will be described with reference to FIGS. 3, 4, 5A, and 5B. FIG. 4 is a schematic perspective view of the configuration of the process cartridge 1 viewed from the upstream side in the mounting direction of the process cartridge 1. FIG. 5A is a schematic perspective view of the configuration of the process cartridge 1 viewed from the downstream side in the mounting direction of the process cartridge 1 and in view of the cleaning unit 4. FIG. 5B is a schematic perspective view of the configuration of the process cartridge 1 viewed from the downstream side in the mounting direction of the process cartridges 1 and in view of the developing unit 6.

As illustrated in FIGS. 3 and 4, the process cartridge 1 is composed of the cleaning unit 4 and the developing unit 6. The cleaning unit 4 and the developing unit 6 are combined to be swingable about a rotation support pin 30.

As illustrated in FIG. 3, the cleaning unit 4 includes a cleaning frame 5 supporting various members in the cleaning unit 4. The cleaning unit 4 further includes a waste toner screw 15 extending in the direction parallel to the rotation axial direction of the photosensitive drum 7, in addition to the photosensitive drum 7, the charging roller 8, and the cleaning blade 10. On the cleaning frame 5, a cleaning bearing 33 is at each of both ends of the cleaning unit 4 in the longitudinal direction thereof. The cleaning bearing 33 rotatably supports the photosensitive drum 7, and includes a cleaning gear train 31 for transmitting a driving force from the photosensitive drum 7 to the waste toner screw 15.

The charging roller 8 in the cleaning unit 4 is urged in the direction indicated by an arrow C toward the photosensitive drum 7, by a charging roller pressure spring 36 at each of both ends of the charging roller 8 in the axial direction thereof. The charging roller 8 rotates following the photosensitive drum 7, and the driven rotation of the photosensitive drum 7 in the direction indicated by the arrow A in image formation causes the charging roller 8 to rotate in the direction indicated by an arrow D (in the forward direction with respect to the rotation of the photosensitive drum 7).

The cleaning blade 10 in the cleaning unit 4 is composed of an action member 10*a* for removing residual toner (waste toner) remaining on the surface of the photosensitive drum 7 after the primary transfer, and a support member 10*b* for supporting the action member 10*a*. The waste toner removed from the surface of the photosensitive drum 7 with the cleaning blade 10 is stored in a waste toner storage chamber 9 formed by the cleaning blade 10 and the cleaning frame 5. The waste toner stored in the waste toner storage chamber 9 is conveyed toward the back of the image forming apparatus 100 (toward the downstream side in the mounting direction of the process cartridge 1) by the waste toner screw 15 in the waste toner storage chamber 9. The conveyed waste toner is discharged out of a waste toner discharge port 35 illustrated in FIG. 5A, and is delivered to the waste toner conveyance unit 23 in the main body of the image forming apparatus 100.

The developing unit 6 includes a developing frame 16 supporting various members in the developing unit 6. The developing frame 16 is divided into a developing chamber 16*a* including the developing roller 11 and a supply roller 17, and a toner storage chamber 16*b* storing toner and including a stirring member 29.

The developing roller 11, the supply roller 17, and a developing blade 28 are in the developing chamber 16*a*. The developing roller 11 bears toner, and rotates in the direction indicated by an arrow E to supply toner to the photosensitive drum 7 in contact with the photosensitive drum 7 in image formation. Further, the developing roller 11 is rotatably supported on the developing frame 16 by a development bearing unit 34, at each of both ends in the longitudinal direction (the rotation axial direction) thereof. The supply roller 17 is in contact with the developing roller 11, and rotatably supported on the developing frame 16 by the development bearing unit 34, and rotates in the direction indicated by an arrow F in image formation. Further, the developing blade 28 serving as a layer-thickness regulating member for regulating the thickness of a toner layer formed on the developing roller 11 is in contact with the surface of the developing roller 11.

The stirring member 29 for stirring toner (toner T) and conveying toner to the supply roller 17 through a developing chamber communication port 16*c* is in the toner storage chamber 16*b*. The stirring member 29 includes a rotating shaft 29*a* parallel with the rotation axial direction of the developing roller 11, and a stirring sheet 29*b* serving as a conveyance member that is a flexible sheet. One end of the stirring sheet 29*b* is attached to the rotating shaft 29*a*, and the other end of the stirring sheet 29*b* is a free end. The rotation of the rotating shaft 29*a* in the direction indicated by an arrow G causes toner to be stirred by the stirring sheet 29*b*.

The developing unit 6 includes the developing chamber communication port 16*c* through which the developing chamber 16*a* communicates with the toner storage chamber 16*b*. In the present exemplary embodiment, the developing chamber 16*a* is located above the toner storage chamber 16*b*, in the orientation when the developing unit 6 is normally used (the orientation when in use). Toner in the toner storage chamber 16*b* is scooped by the stirring member 29 and scooped toner is supplied to the developing chamber 16*a* through the developing chamber communication port 16*c*.

Further, as illustrated in FIG. 5B, a toner receiving inlet 40 is located at one end of the developing unit 6, downstream in the mounting direction of the process cartridge 1. An inlet seal member 45 and a toner receiving inlet shutter 41 movable in the front-back direction are at the toner receiving inlet 40. With no process cartridge 1 mounted in the apparatus main body, the toner receiving inlet 40 is closed with the toner receiving inlet shutter 41. The toner receiving inlet shutter 41 opens and closes interlocking with the mounting/removing operation of the process cartridge 1. As the process cartridge 1 is mounted, the apparatus main body forces the toner receiving inlet shutter 41 open.

As illustrated in FIG. 3, a receiving conveyance passage 42 communicates with the toner receiving inlet 40, and includes a receiving conveyance screw 43. Further, a storage chamber communication port 44 for supplying toner to the toner storage chamber 16*b* is near the center of the developing unit 6 in the longitudinal direction thereof, and is connected with the receiving conveyance passage 42 and the toner storage chamber 16*b*. The receiving conveyance screw 43 extends in the direction parallel to the rotation axial direction of the developing roller 11 and the supply roller 17, and conveys toner received from the toner receiving inlet 40 to the toner storage chamber 16*b* through the storage chamber communication port 44.

<Toner Cartridge>

Next, an overall configuration of a cartridge 13 (the toner supply device) to be mounted in the image forming apparatus 100 according to the present exemplary embodiment will be described with reference to FIGS. 6, 7A, 7B, 8, 9A, and 9B. In the present exemplary embodiment, the cartridge 13K storing toner of black (K) has a larger toner capacity than those of the other three color cartridges 13Y, 13M, and 13C. Except for the capacity, the configurations of the four cartridges 13 are substantially the same. The following is a description with reference to the drawings of configurations of the cartridges 13Y, 13M, and 13C, which store color toners yellow (Y), magenta (M), and cyan (C), respectively. The indexes Y, M, and C of the reference numerals will be omitted in the description.

Figure 6:
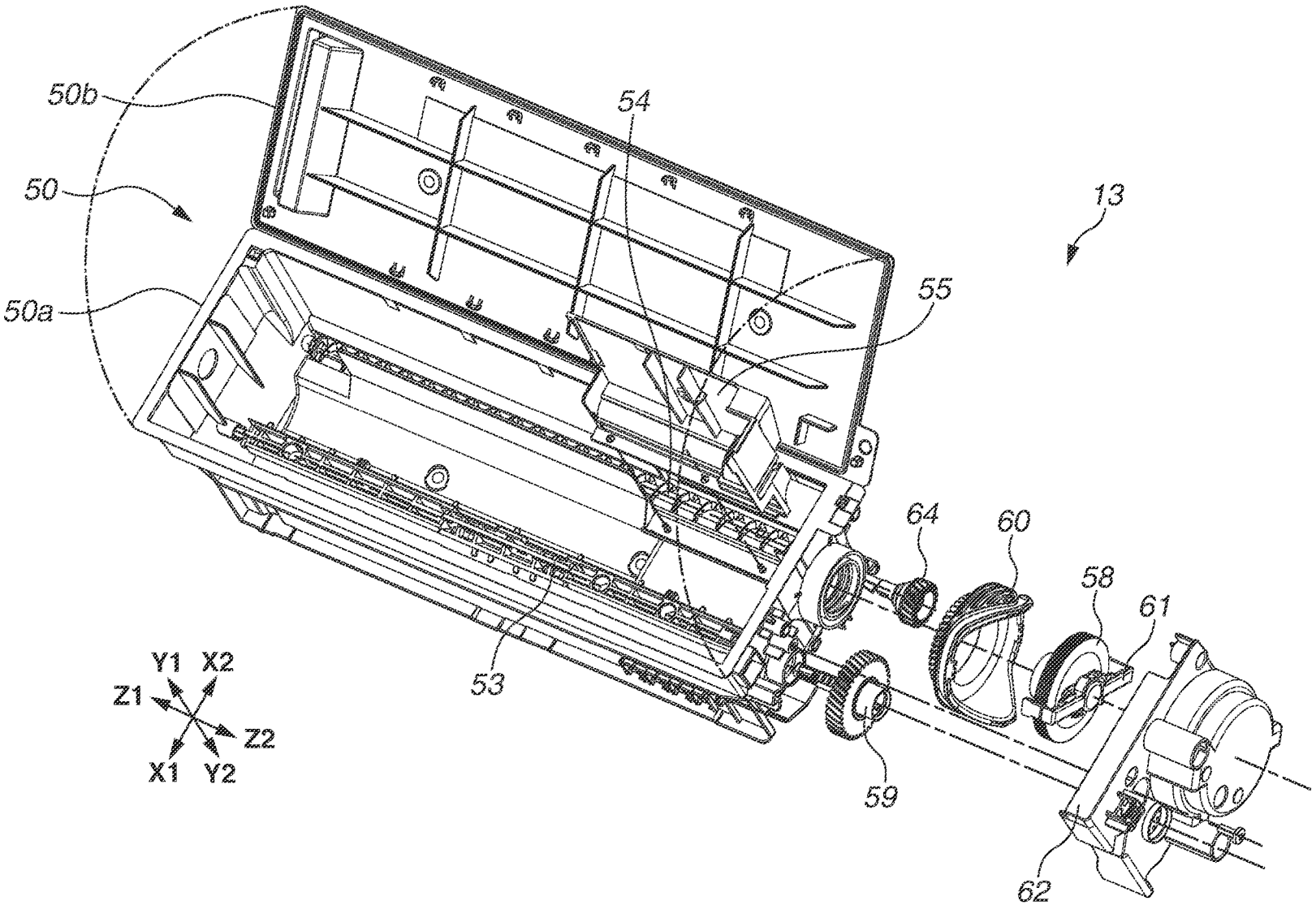
FIG. 6 is an exploded perspective view of a toner cartridge.
Figure 7A:
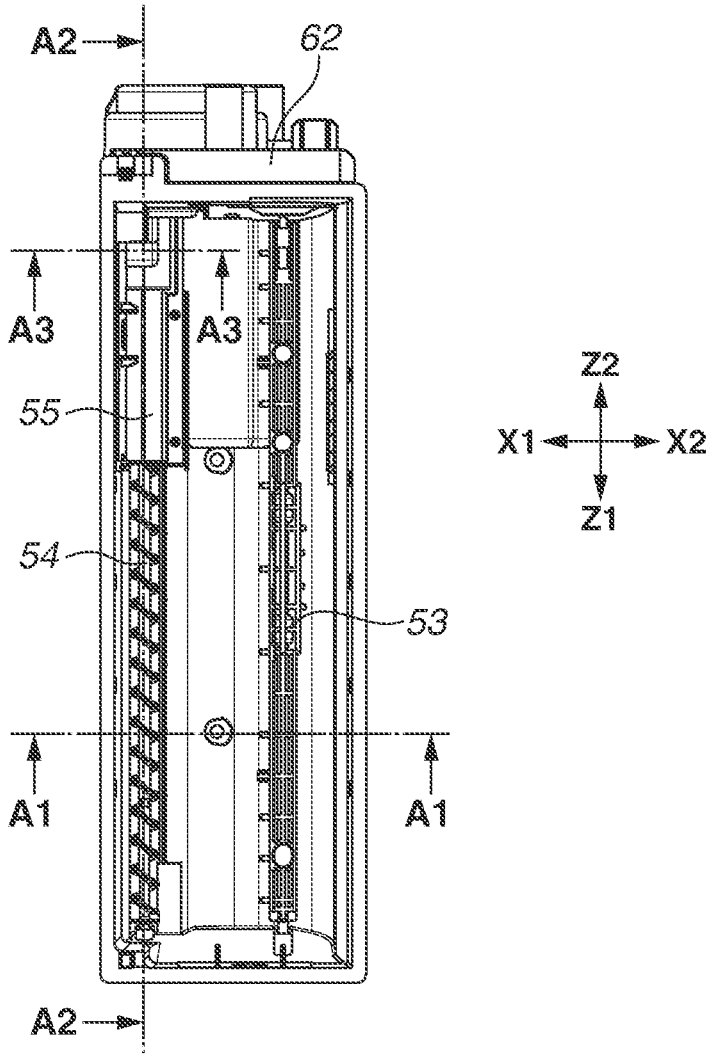
FIG. 7A is a schematic cross-sectional view of the toner cartridge viewed from above.
Figure 7B:
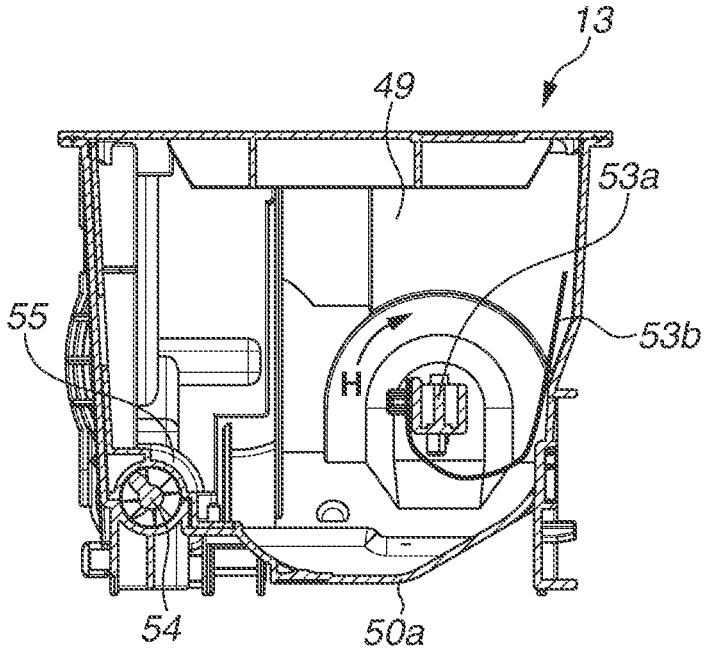
FIG. 7B is a partial cross-sectional view of the toner cartridge.
Figure 8:
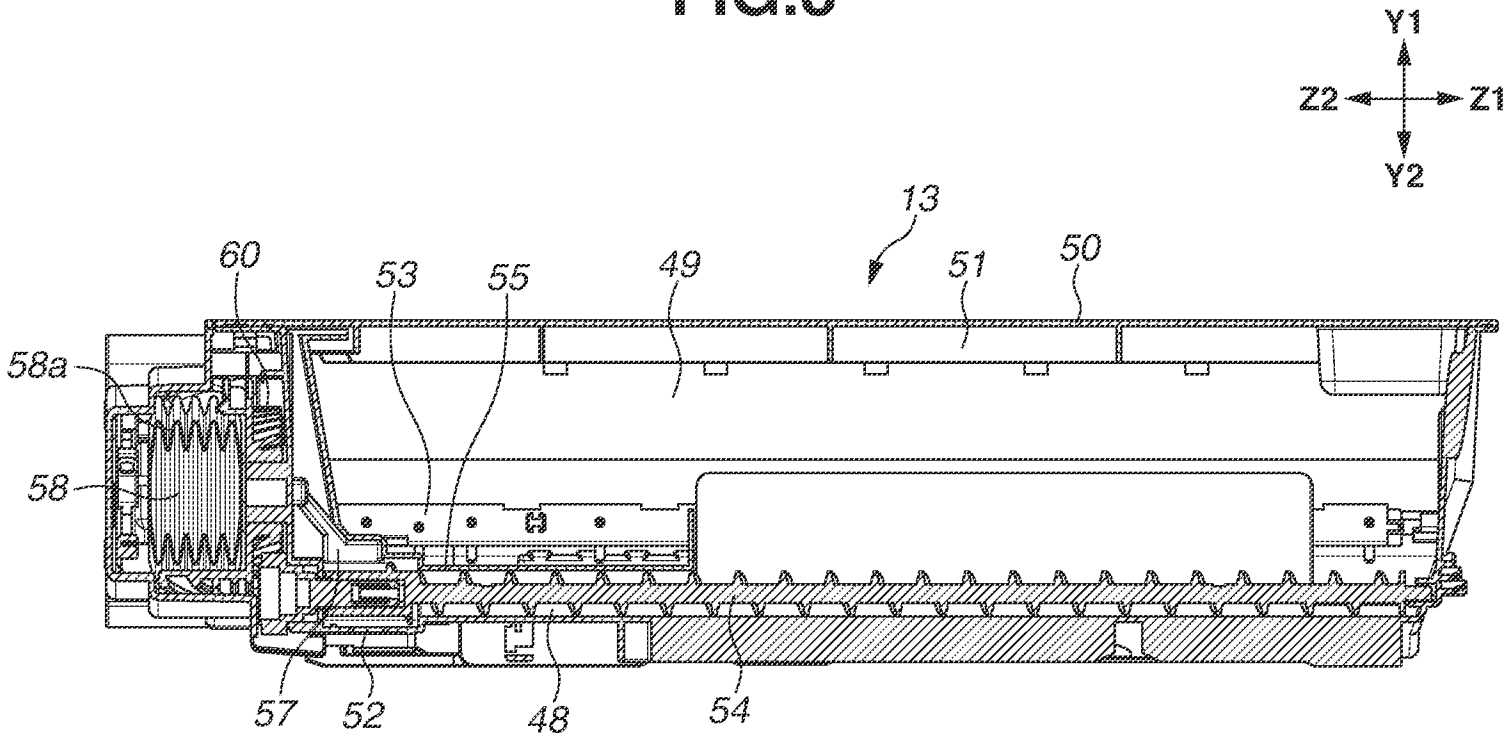
FIG. 8 is a schematic cross-sectional view of the toner cartridge viewed from the transverse direction.
Figure 9A:
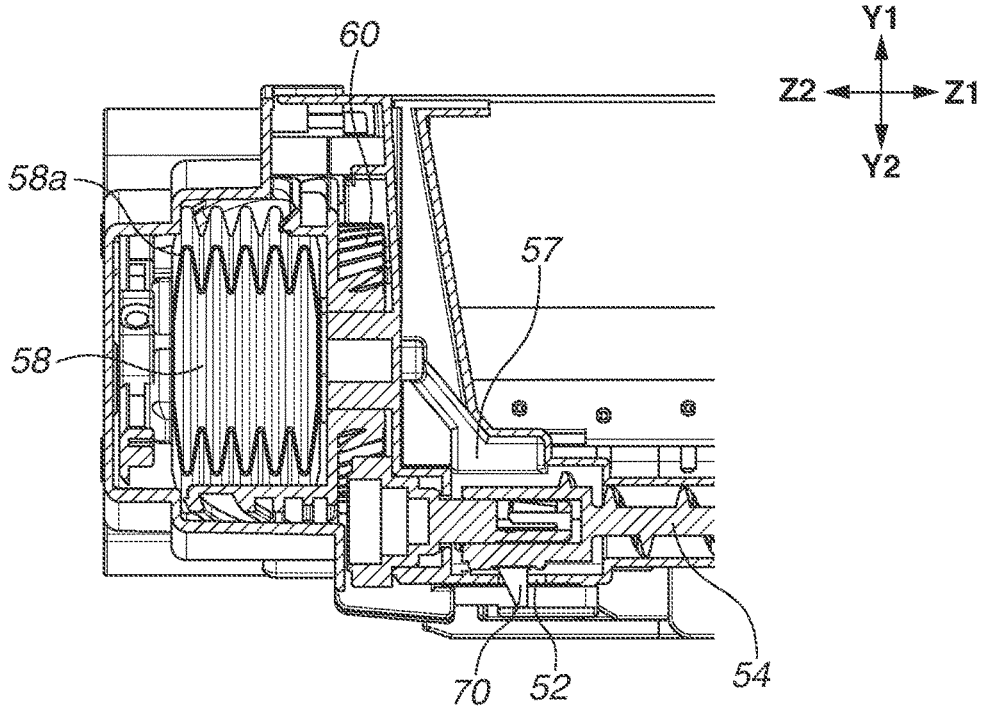
FIGS. 9A and 9B are expanded cross-sectional views of a configuration of a pump of the toner cartridge and a configuration around the pump.
Figure 9B:
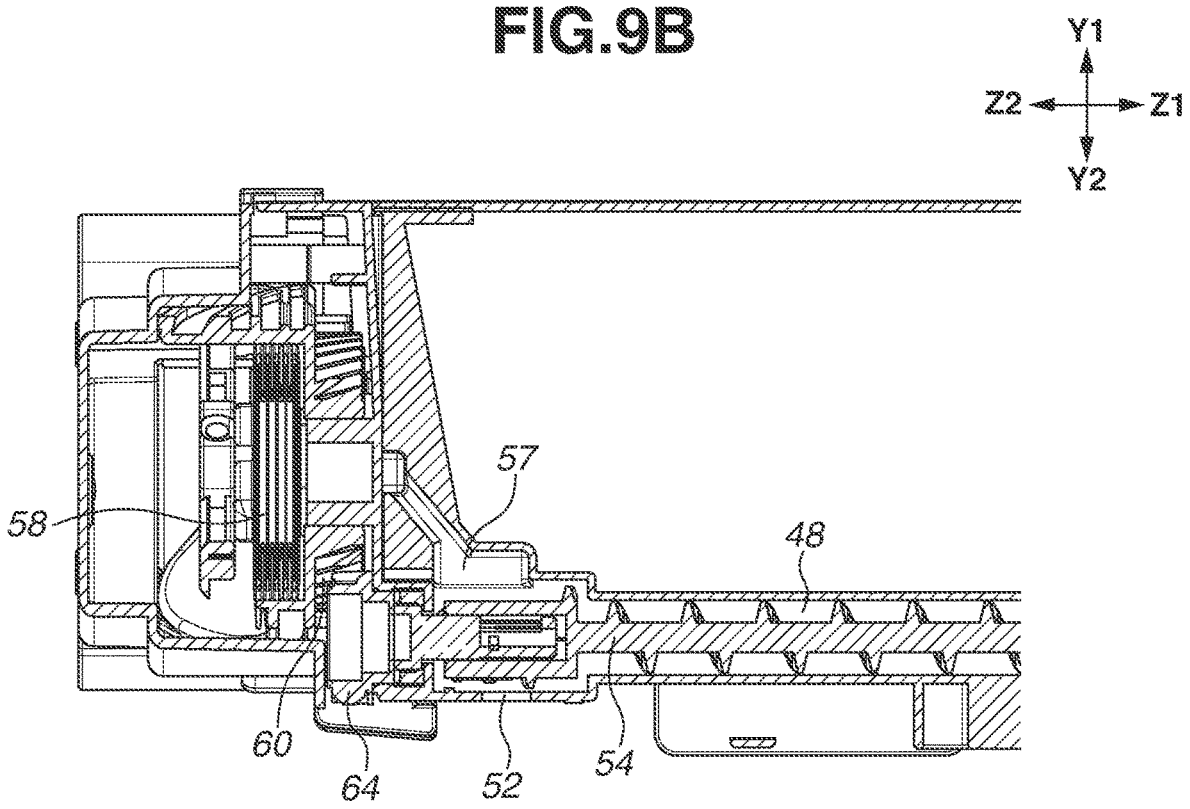

FIG. 6 is a schematic perspective view of a partially exploded configuration of the cartridge 13 according to the present exemplary embodiment. FIG. 7A is a schematic cross-sectional view of the cartridge 13 viewed from above, and FIG. 7B is a cross-sectional view taken along a line A1-A1 in FIG. 7A. FIG. 8 is a schematic cross-sectional view of the configuration of the cartridge 13 taken along a line A2-A2 in FIG. 7A. FIG. 9A is a schematic view of a pump 58 being expanded in the expansion/contraction direction thereof in the present exemplary embodiment, and FIG. 9B is a schematic view of the pump 58 being contracted in the expansion/contraction direction in the present exemplary embodiment.

In the following description, on the assumption that the cartridge 13 is in a normal orientation, in which the cartridge 13 is mounted in the apparatus main body, directions indicated by arrows X1, X2, Y1, Y2, Z1, and Z2 using an X-axis, a Y-axis, and a Z-axis are defined as follows. Here, the X-axis, the Y-axis, and the Z-axis are orthogonal to each other.

The upward direction opposite the gravity direction and the downward direction in the gravity direction are indicated by the Y-axis. The upward direction is indicated by the arrow Y1, and the downward direction is indicated by the arrow Y2. The surface at the end of the cartridge 13 in the Y1 direction will be referred to as the upper surface (the top surface), and the surface at the end in the Y2 direction will be referred to as the bottom surface. The upper surface of the cartridge 13 faces upward (in the Y1 direction), and the bottom surface faces downward (in the Y2 direction).

The frontward and backward directions are indicated by the Z-axis. In the mounting direction in mounting the cartridge 13 in the apparatus main body, the upstream direction is indicated by the arrow Z1, and the downstream direction is indicated by the arrow Z2. The Z1 direction is the frontward direction, and the Z2 direction is the backward direction. In other words, the surface at the end of the cartridge 13 in the Z1 direction will be referred to as the front surface, and the surface at the end in the Z2 direction will be referred to as the back surface. The front surface of the cartridge 13 faces frontward (in the Z1 direction), and the back surface thereof faces backward (in the Z2 direction). The extent from the front surface to the back surface (the extent in the Z-axis direction) is in the longitudinal direction of the cartridge 13.

Further, the leftward and rightward directions are dedicated by the X-axis. Viewed in the direction of mounting the cartridge 13 in the apparatus main body, the leftward direction is indicated by the arrow X1, and the rightward direction is indicated by the arrow X2. The surface at the end of the cartridge 13 in the X1 direction will be referred to as the left side surface (the left surface), and the surface at the end in the X2 direction will be referred to as the right side surface (the right surface). The left side surface of the cartridge 13 faces leftward (in the X1 direction), and the right side surface faces rightward (in the X2 direction). The direction from the left side surface to the right side surface (i.e., the extent along the X-axis) is in the transverse direction of the cartridge 13.

In the present exemplary embodiment, the distance between the front surface and the back surface of the cartridge 13 is longer than the distance between the right side surface and the left side surface, and longer than the distance between the top surface and the bottom surface. The distance between the right side surface and the left side surface is shorter than the distance between the top surface and the bottom surface. However, the present exemplary embodiment is not limited to such a configuration. For example, the distance between the right side surface and the left side surface or the top surface and the bottom surface of the cartridge 13 may be the longest.

Toner to be supplied to the corresponding developing unit 6 by the cartridge 13 is supplied to the corresponding process cartridge 1 by the corresponding toner conveyance device 14 as described above. In short, the cartridge 13 stores the toner to be supplied to the process cartridge 1.

As illustrated in FIG. 6, the cartridge 13 of the present exemplary embodiment includes a supply frame (a casing or frame) 50. The supply frame 50 includes a container 50*a* and a cover 50*b*, and the cover 50*b* is added to the container 50*a*. The container 50*a* and the cover 50*b* form an internal space 51 in the supply frame 50. The cover 50*b* is at the end of the cartridge 13 in the Y1 direction, and forms the upper surface of the cartridge 13 (the upper surface of the supply frame 50).

The supply frame 50 includes a partition member (a partition) 55 in the internal space 51, and the internal space 51 is further partitioned into a plurality of areas by the partition member 55. In other words, as illustrated in FIG. 8, the partition member 55 partitions the internal space 51 into a plurality of rooms (spaces) including a toner storage chamber 49, a communication passage 48, and a toner discharge chamber 57. The partition member 55 can be regarded as a part of the supply frame 50 or be actually formed integrally with the supply frame 50.

Further, a gear train composed of a driving force input gear 59, a cam gear 60 (a first gear), and a screw gear 64 (a second gear), and the pump 58 are attached near the end (the rear end, or the back surface) of the supply frame 50 in the Z2 direction. To cover the gear train and the pump 58, a side cover 62 is attached outside these members. In particular, the movement of the cam gear 60 is restricted by the side cover 62 and the supply frame 50 in the Z1 and Z2 directions.

As illustrated in FIGS. 6 to 8, a stirring member 53 and a screw 54 (a conveyance member) are in the internal space 51 of the supply frame 50. The screw 54 extends from the upstream (the Z1 direction) to the downstream (the Z2 direction) in the mounting direction of the cartridge 13. Further, as illustrated in FIG. 8, the screw 54 has a part extending in the Z1 direction and in the Z2 direction covered with the partition member 55. The part of the screw 54 covered with the partition member 55 forms a tunnel-shaped space as the communication passage 48 in the partition member 55.

Each of the rooms (spaces) formed in the internal space 51 of the supply frame 50 will be described in detail.

[Toner Storage Chamber]

As illustrated in FIGS. 7A and 7B, the toner storage chamber (a developer storage chamber) 49 has a space for storing toner (developer), and the stirring member 53 for stirring the toner is in the toner storage chamber 49. The stirring member 53 extends in the direction parallel to the longitudinal direction of the cartridge 13, and is rotatably supported by the supply frame 50.

The stirring member 53 includes a rotating shaft 53*a* and a supply stirring sheet 53*b* as a flexible sheet member. The rotating shaft 53*a* extends in the direction where the stirring member 53 extends (the longitudinal direction of the cartridge 13). Further, one end of the supply stirring sheet 53*b* is attached to the rotating shaft 53*a*. The other end of the supply stirring sheet 53*b* is a free end, and the rotation of the rotating shaft 53*a* causes the supply stirring sheet 53*b* to rotate in the direction indicated by an arrow H illustrated in FIG. 7B. The rotation of the supply stirring sheet 53*b* causes the toner stored in the toner storage chamber 49 to be stirred and conveyed to the screw 54 serving as a supply conveyance screw to be described below.

[Communication Passage]

The communication passage 48 is a space in which the toner storage chamber 49 communicates with the toner discharge chamber 57 to be described below, and the toner travels in this space. The communication passage 48 is formed by the partition member 55 and the supply frame 50. As described above, the part of the screw 54 is in the communication passage 48. To be more specific, in the internal space 51 of the supply frame 50 as illustrated in FIG. 8, the partition member 55 is not in an area of the screw 54 in the Z1 direction but in an area in the Z2 direction. The space partitioned by the partition member 55 in the Z2 direction is the communication passage 48, and the space of the screw 54 in the Z1 direction directly is connected with the toner storage chamber 49. In other words, the screw 54 is in both the space directly connected with the toner storage chamber 49 and the communication passage 48.

The screw 54 is a member movable relative to the supply frame 50, and more specifically, the screw 54 is rotatably supported by the supply frame 50. The screw 54 rotates to convey toner in the toner storage chamber 49 in the rotation axial direction of the screw 54 from the part exposed in the toner storage chamber 49 extending in the Z1 direction toward the communication passage 48 extending in the Z2 direction.

As described above, the communication passage 48 is formed in a tunnel shape by the partition member 55 and the supply frame 50, and extends in the direction of the toner conveyance by the screw 54*e*. Further, the screw 54 is partially covered to be in the communication passage 48. The tunnel shape of the communication passage 48 is formed to accommodate to the external form of the screw 54.

The communication passage 48 plays a role of regulating the amount of toner conveyed by the screw 54 to convey a predetermined amount of toner. To be more specific, some toner conveyed by the screw 54 toward the communication passage 48 enters the communication passage 48 and moves to the toner discharge chamber 57, but the other toner does not enter the communication passage 48 and remains in the toner storage chamber 49. The amount of the toner entering the communication passage 48 is adjusted in a ratio set as appropriate between the size of the opening of the tunnel formed by the communication passage 48 and the size of the screw 54. Thus, the screw 54 extending in the communication passage 48 allows a predetermined amount of toner to be supplied from the toner storage chamber 49 into the toner discharge chamber 57.

[Toner Discharge Chamber]

As illustrated in FIGS. 8, 9A, and 9B, the toner discharge chamber 57 is a space formed by the partition member 55 and the supply frame 50, and is disposed downstream from the communication passage 48 in the conveyance direction (the Z2 direction) in which the screw 54 conveys toner.

Near the toner discharge chamber 57, which is near the back surface (the end in the Z2 direction) of the supply frame 50, is disposed the screw gear 64 to receive a rotary force for rotating the screw 54. Further, the toner discharge chamber 57 has an outlet 52 for discharging toner from the internal space 51 of the supply frame 50 to the outside. The outlet 52 is formed in the bottom surface of the cartridge 13 (the bottom surface of the supply frame 50), and toner is discharged downward out of the outlet 52. Further, as illustrated in FIG. 2, below the cartridge 13 lies the corresponding toner conveyance device 14 and the toner discharged from the outlet 52 is put in the toner conveyance device 14 and then conveyed to the corresponding process cartridge 1 by the toner conveyance device 14. The outlet 52 is disposed downstream of the cartridge 13 in the conveyance direction of the screw 54. In other words, the distance between the outlet 52 and the back surface (the end in the Z2 direction) of the cartridge 13 is shorter than the distance between the outlet 52 and the front surface (the end in the Z1 direction) of the cartridge 13.

Furthermore, the pump 58 is near the back surface (the end in the Z2 direction) of the cartridge 13. The pump 58 includes a bellows portion (a movable portion) 58*a* to expand and contract to change the volume of the internal space, and the pump 58 communicates with the inside of the toner discharge chamber 57. The cam gear 60 rotates to expand or contract the bellows portion 58*a*, changing the internal volume of the internal space of the bellows portion 58*a*. In other words, the pump 58 is configured to expand and contract in the range between a first state of a relatively larger volume of the internal space of the bellows portion 58*a* and a second state of a relatively smaller volume of the internal space of the bellows portion 58*a* than that in the first state. The first state and the second state are a maximized capacity and a minimized capacity of the bellows portion 58*a*, respectively, formed by the rotation of the cam gear 60.

As illustrated in FIG. 6, the cam gear 60 engages the driving force input gear 59 and the screw gear 64, and configured to be rotated by a driving force received from the driving force input gear 59 and thereby to transmit the rotary force to the screw gear 64.

The varying internal pressure (internal atmospheric pressure) of the toner discharge chamber 57 with the expansion/ contraction of the pump 58 makes a difference between an atmospheric pressure outside the cartridge 13 and the pressure inside the toner discharge chamber 57. The outlet 52 takes in and releases air due to pressure differences, and the flows of the air contributes to the discharge of toner out of the outlet 52 toward the toner conveyance device 14.

To be more specific, as the capacity of the pump 58 increases through expansion of the pump 58 as illustrated in FIG. 9A, the atmospheric pressure in the pump 58 and the toner discharge chamber 57 decreases, whereby air is taken into the toner discharge chamber 57 through the outlet 52. In other words, a shift from the second state to the first state of the bellows portion 58*a* causes air to be taken into the toner discharge chamber 57 through the outlet 52. On the other hand, as the capacity decreases through contraction of the pump 58 as illustrated in FIG. 9B, the atmospheric pressure in the pump 58 and the toner discharge chamber 57 increases, whereby toner is discharged with air from the inside of the toner discharge chamber 57 to the outside through the outlet 52. In other words, a shift from the first state to the second state of the bellows portion 58*a* causes air to be sent from the bellows portion 58*a* into the toner discharge chamber 57, whereby toner is discharged from the toner discharge chamber 57 through the outlet 52. These processes are repeated so that toner is intermittently discharged from the inside of the cartridge 13 to the outside through the outlet 52 in the configuration of the present exemplary embodiment.

[Configuration of Action Member]

Figure 1:
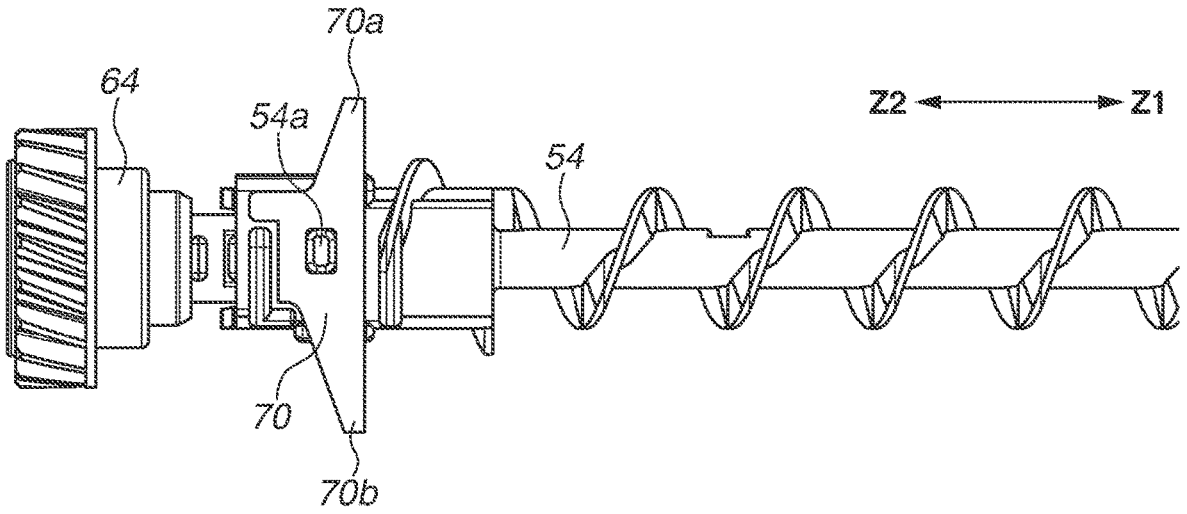
FIG. 1 is a schematic view of a configuration of an action member.

Next, a configuration of an action member 70 according to the present exemplary embodiment will be described with reference to FIG. 1. FIG. 1 is an enlarged view of the end of the screw 54 in the Z2 direction.

As illustrated in FIGS. 1 and 9A, the action member 70 is mounted at the position of the screw 54 above the outlet 52. In the present exemplary embodiment, a sheet-like elastic member, more specifically, a resin sheet (a polycarbonate sheet) with a thickness of 100 μm, is used for the action member 70. The action member 70 is fixed to the screw 54 by thermal fixing by melting the upper portion of a boss 54*a* flat on the action member 70. As illustrated in FIG. 1, the action member 70 includes a first blade 70*a* (a first action portion) and a second blade 70*b* (a second action portion) each protruding in a direction orthogonal to the rotation axial direction of the screw 54. These blades of the action member 70 repeat entries into and exits (retract) from the outlet 52, as the screw 54 rotates. The actions of an entry into and an exit from the outlet 52 of the action member 70 allows the toner near the outlet 52 to get loosened. As the screw 54 rotates, the action member 70 repeatedly shifts from an entering state where the action member 70 enters the outlet 52 to a retraction state where the action member 70 retracts from the outlet 52, and vice versa.

[Action of Action Member]

Next, the action of the action member 70 will be described more in detail with reference to FIGS. 9A, 9B, and 10A to 10D. FIGS. 10A to 10D are schematic cross-sectional views illustrating the action of the action member 70, each taken along a line A3-A3 in FIG. 7A. As illustrated in FIGS. 10A to 10D, the screw 54 rotates in the direction indicated by an arrow R1, and the action member 70 rotates with the screw 54 while deforming inside the toner discharge chamber 57.

Figure 10A:
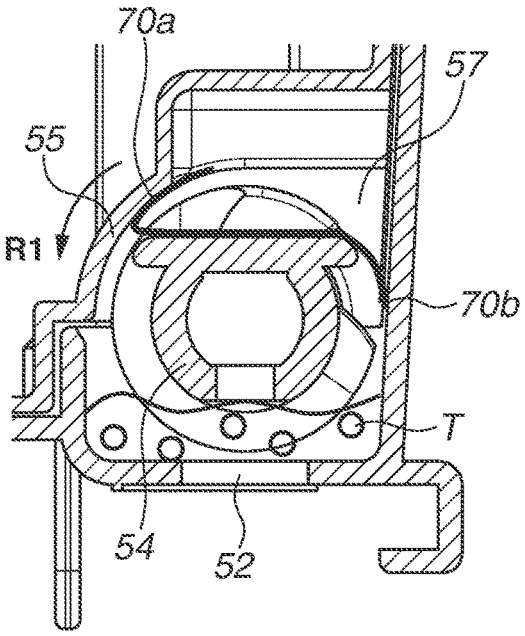
FIGS. 10A to 10D are schematic cross-sectional views illustrating the action of the action member.

FIG. 10A illustrates a driven state of the screw 54 at a moment, a state where the attachment surface of the action member 70 is at the position opposite the rotating shaft of the screw 54 remote from the outlet 52 and is horizontal to the opening surface of the outlet 52. In this state, the first blade 70*a* and the second blade 70*b* are deformed along the partition member 55 and the supply frame 50 due to the flexibility of the action member 70. As described above here, a certain amount of toner is constantly sent into the toner discharge chamber 57 by the screw 54 through the communication passage 48, and thus the space near the outlet 52 is filled with a constant amount of toner.

Figure 10B:
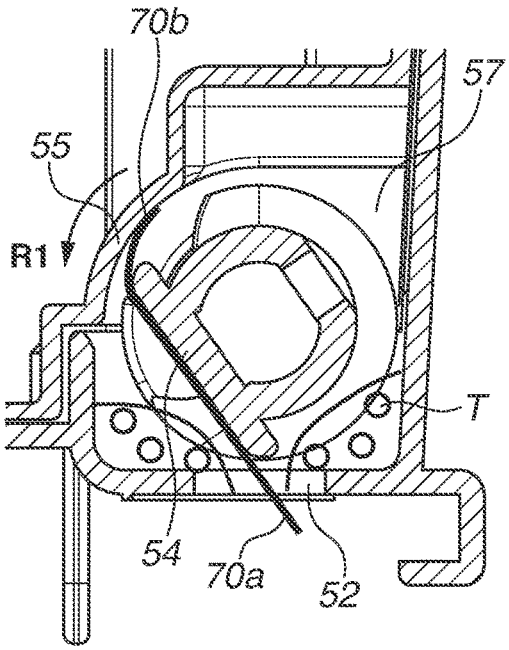

When the screw 54 rotates after the state in FIG. 10A in the R1 direction, the deformation of the first blade 70*a* arriving at the outlet 52 is relieved and the first blade 70*a* enters the outlet 52 as illustrated in FIG. 10B. As the first blade 70*a* thus enters the outlet 52, the toner in and near the outlet 52 gets loose, increasing the flowability of the toner. The action member 70 as flexible sheet material allows the blade of the action member 70 to enter the outlet 52, having an effect of loosening toner. In addition, in the configuration of the present exemplary embodiment, the first blade 70*a* enters the outlet 52 but does not cover the outlet 52 completely as illustrated in FIG. 10B, and thus the discharge of the toner is not disrupted even if the pump 58 contracts to perform the discharge operation.

Figure 10C:
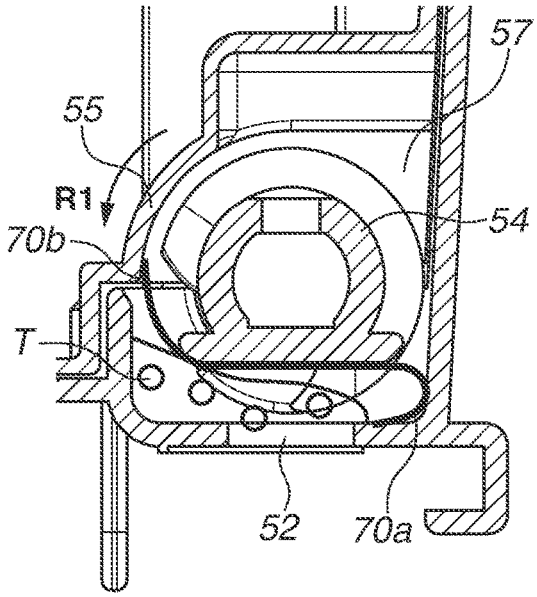

When the screw 54 rotates after the state in FIG. 10B further in the R1 direction, the first blade 70*a* exits from the outlet 52, as illustrated in FIG. 10C. In this state, the first blade 70*a* and the second blade 70*b* are deformed along the partition member 55 and the supply frame 50, as with the state in FIG. 10A. In the state in FIG. 10C, the attachment surface of the action member 70 is horizontal to the opening surface of the outlet 52.

Figure 10D:
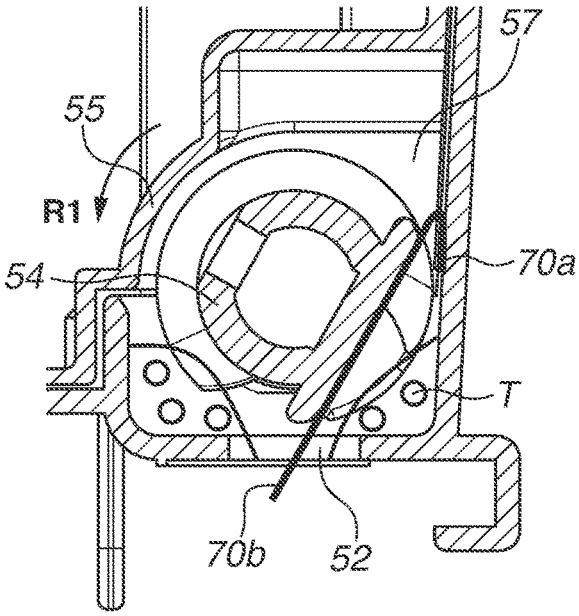

When the screw 54 rotates after the state in FIG. 10C further in the R1 direction, the second blade 70*b* opposite the first blade 70*a* arrives at the outlet 52 and the deformation of the second blade 70*b* is relieved in the outlet 52, as illustrated in FIG. 10D. The second blade 70*b* thereby enters the outlet 52. In this state, as the second blade 70*b* enters the outlet 52, the toner in and near the outlet 52 gets loosened, increasing the flowability, bringing the toner into a state suitable for the discharge of the toner, as with the state described with reference to FIG. 10B.

As described above, the action member 70 shifts from the state in FIG. 10A to the state in FIG. 10D to cause the two blades to alternately repeat an entry into and an exit from the outlet 52 while the screw 54 rotates once, allowing the toner in and near the outlet 52 to get loosened. In short, the two blades alternately repeat the action of shifting from the retraction state via the entering state to the retraction state again.

[Cyclic Relationship Between Expansion/Contraction of Pump and Rotation of Action Member]

Figures 11A, 11B, 11C:
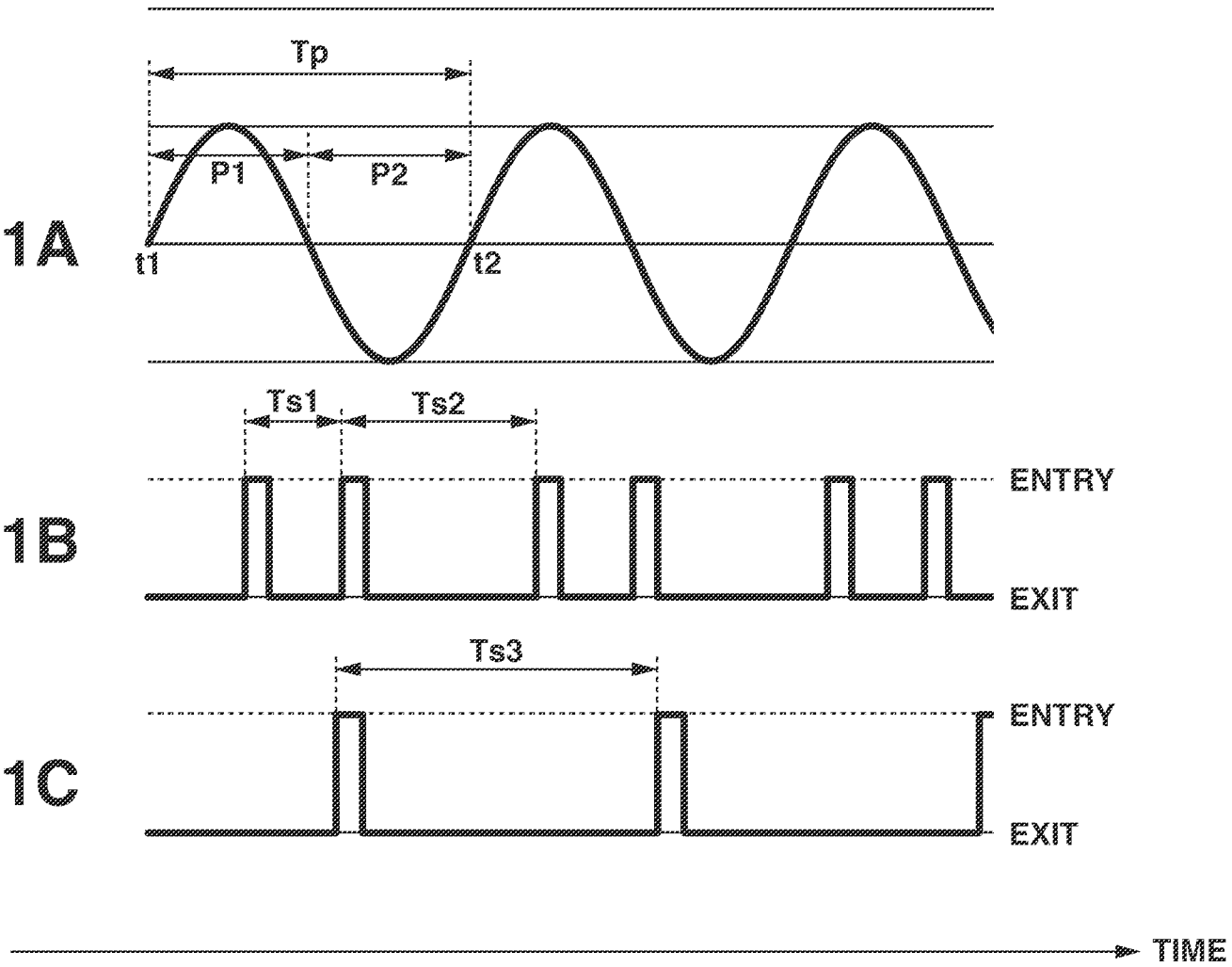
FIG. 11A is a graph illustrating the relationship between the change in internal pressure of a toner discharge chamber through expansion/contraction of the pump and time (t)
FIG. 11B is a graph illustrating the relationship between entries and exits of the action member according to an exemplary embodiment into and from an outlet and time (t)
FIG. 11C is a graph illustrating the relationship between entries and exits of an action member according to a modification example into and from the outlet and time (t).

Next, the cyclic relationship between the expansion/contraction action of the pump 58 and the rotation of the action member 70 in the present exemplary embodiment will be described with reference to FIGS. 11A to 11C. FIG. 11A is a graph illustrating the relationship between the change in the internal pressure of the toner discharge chamber 57 and time (t) through the expansion/contraction action of the pump 58 in operation. FIG. 11B is a graph illustrating the relationship between entries and exits of the action member 70 in the present exemplary embodiment into and from the outlet 52 and time (t). FIG. 11C is a graph illustrating the relationship between entries and exits into and from the outlet 52 of the action member and time (t) with an action member having the first blade, as a modification example of the present exemplary embodiment.

As illustrated in FIG. 11A, the pump 58 moves to expand and contract as the cam gear 60 is rotated by the driving force received from the driving force input gear 59, fluctuating the internal pressure of the toner discharge chamber 57 in a cycle (Tp) of the expansion/contraction of the pump 58. In the configuration of the present exemplary embodiment, the rotation speed of the cam gear 60 is set to 79 (rpm), and the cycle Tp of the pump is set to 0.38 (sec). In FIG. 11A, an area P1 is an area where the internal pressure of the toner discharge chamber 57 is higher than the external pressure, and an area P2 is an area where the internal pressure of the toner discharge chamber 57 is lower than the external pressure. The internal pressure of the toner discharge chamber 57 fluctuates as the pump 58 expands and contracts as illustrated in FIG. 11A. As described above, toner is discharged from the outlet 52 as the pump 58 contracts, specifically, in the area P1.

FIG. 11B illustrates the relationship between entries and exits of the first blade 70*a* and the second blade 70*b* of the action member 70 into and from the outlet 52 in expansion/contraction cycles of the pump 58, described in the present exemplary embodiment. In the present exemplary embodiment, the screw gear 64 is rotated by a driving force received from the cam gear 60, which causes the screw 54 to rotate. In other words, the cam gear 60 for driving the pump 58 and the screw gear 64 for driving the screw 54 engage, allowing the blades of the action member 70 to enter and exit the outlet 52 in harmony with expansion/contraction cycles of the pump 58. Such a configuration makes it easy for the expansion/contraction cycle of the pump 58 and the action of the action member 70 to be cyclic.

In the present exemplary embodiment, the rotation speed of the screw 54 is set to 174 (rpm), and the cycles of the two blades of the action member 70 are set to 0.11 (sec) as a time period Ts1 and 0.24 (sec) as a time period Ts2. The time period Ts1 in FIG. 11B here is a time interval from the moment that the first blade 70*a* enters the outlet 52 to the moment that the second blade 70*b* enters the outlet 52. The time period Ts2 is a time interval from the moment that the second blade 70*b* enters the outlet 52 to the moment that the first blade 70*a* enters the outlet 52.

A time t1 in FIG. 11A is a timing that the pump 58 begins to contract to start discharging the toner, and a time t2 is a timing that the pump 58 begins to contract again to start discharging the toner after the pump 58 has contracted and expanded once. In the configuration of the present exemplary embodiment, the toner near the outlet 52 gets loosened twice with the first blade 70*a* and the second blade 70*b* during the time period from the time t1 to the time t2 (one cycle of the expansion/contraction of the pump 58), as illustrated in FIGS. 11A and 11B. This provides a stable discharge operation of the toner through the action of the action member 70 with the expansion/contraction of the pump 58. The time period from the time t1 to the time t2 (one cycle of the expansion/contraction of the pump 58), in other words, is a time period from the moment that the pump 58 discharges the toner from the outlet 52, through one intake of air, to the moment that the toner is next discharged from the outlet 52.

To discharge the toner stably through the action of the action member 70 with the expansion/contraction of the pump 58, it is suitable to perform the entry and exit action of the blade of the action member 70 into and from the outlet 52 at least once, during the time period from the time t1 to the time t2. Namely, with the first and second blades provided as in the present exemplary embodiment, it is suitable that the cycle Tp of the pump 58 is longer than or equal to the time period Ts1 and longer than or equal to the time period Ts2. In other words, it is suitable that the action member 70 goes through the action from the exit (retraction) state through the entering state then to the exit state again, at least once, during the time period that the pump 58 is shifted from the second state (FIG. 9A), via the first state (FIG. 9B), to the second state again (FIG. 9A).

To loosen the toner near the outlet 52 at least once during the time period from the time t1 to the time t2, the action member may have one blade, one of the two blades illustrated in FIG. 1, as a modification example, instead of having the two blades in the present exemplary embodiment. In this case, the cycle of entry and exit of the action member into and from the outlet 52 is as illustrated in FIG. 11C. A time period Ts3 in FIG. 11C here is a time interval from the moment that the blade enters the outlet 52, through one rotation of the screw 54 after the blade exits from the outlet 52, to the moment that the blade enters the outlet 52 again. To discharge the toner stably through the action of the action member 70 with the expansion/contraction of the pump 58 in the configuration, it is suitable that the cycle Tp of the pump is longer than or equal to the time period Ts3.

In the configuration of the present exemplary embodiment as described above, in the cartridge 13 to supply toner using the pump 58, the action member 70, attached to the screw 54, is operated with the expansion/contraction of the pump 58. This allows toner near the outlet 52 to be loosened with one or more blades of the action member 70 in harmony with the expansion/contraction cycle of the pump 58, providing a stable discharge of toner from the outlet 52.

In the present exemplary embodiment, the configuration where the cam gear 60 for driving the pump 58 and the screw gear 64 for driving the screw 54 engage has been described, but the present exemplary embodiment is not limited thereto. A different driving unit may transmit a driving force to the screw gear 64 instead of the cam gear 60 as long as the toner near the outlet 52 is loosened at least once during the time period from the time t1 to the time t2 (one cycle of the expansion/contraction of the pump 58).

The action member 70 is not limited to the resin sheet described in the present exemplary embodiment, and another material having a similar function is usable in place of the resin, and the thickness thereof is appropriately adjustable as long as the action member 70 enters and exits the outlet 52 with the rotation of the screw 54. Moreover, the attachment of the action member 70 to the screw 54 is not limited to the thermal fixing described in the present exemplary embodiment, and a fixing method having a function equivalent to the thermal fixing is usable as appropriate.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

What is claimed is:

1. A cartridge comprising:

a toner container provided with a toner outlet through which toner in the toner container is to be discharged to an outside of the cartridge;

a screw configured to rotate so as to convey the toner toward the toner outlet, the screw being provided in the toner container, an elastic member configured to repeat action of shifting between an entering state in which a part of the elastic member enters the toner outlet and a retraction state in which the part of the elastic member retracts from the toner outlet, the elastic member being attached to a downstream end portion of the screw in a conveyance direction in which the screw conveys the toner toward the toner outlet so as to perform the action by a rotation of the screw; and an air supply unit configured to supply air so as to discharge the toner together with the air, through the toner outlet, from the toner container to the outside of the cartridge, wherein the toner container is provided with an air inlet through which the air supplied by the air supply unit is put into the toner container, the air inlet being provided downstream of the elastic member in the conveyance direction.

2. The cartridge according to claim 1, wherein the elastic member is a sheet.

3. The cartridge according to claim 1, wherein the air supply unit is a pump having an internal space, and wherein the pump is configured to expand and contract to be shifted between a first state and a second state in which the internal space is smaller in volume than the internal space in the first state, the pump being configured to put air of the internal space into the toner container by being shifted from the first state to the second state, thereby discharging the toner in the toner container to the outside of the cartridge through the toner outlet, the pump being configured to take in air into the internal space by being shifted from the second state to the first state.

4. The cartridge according to claim 1, wherein the air supply unit is configured to repeat exhaust and intake, and wherein the elastic member is configured to perform the action of shifting from the retraction state through the entering state to the retraction state again, at least once, between the exhaust and intake of the air supply unit.

5. The cartridge according to claim 1, wherein the elastic member is a sheet of which a longitudinal direction is a direction intersecting a rotational axis of the screw.

6. The cartridge according to claim 3, wherein a time period that the pump is shifted from the second state through the first state to the second state again is longer than or equal to a time period that the elastic member is shifted from the retraction state through the entering state to the retraction state again.

7. The cartridge according to claim 2, wherein the sheet includes a first end portion and a second end portion opposite to the first end portion in a longitudinal direction of the sheet, and wherein the first end portion and the second end portion of the sheet are configured to alternately repeat the action of shifting from the retraction state through the entering state to the retraction state again.

8. The cartridge according to claim 1, further comprising:

a first gear configured to drive the air supply unit; and a second gear fixed to an longitudinal end portion of the screw so as to rotate with the screw, the second gear being configured to be rotated by a driving force transmitted from the first gear.

9. The cartridge according to claim 3, wherein the elastic member takes the entering state while the pump is shifted from the first state to the second state.

10. The cartridge according to claim 1, wherein a direction in which the air is supplied toward the toner outlet by the air supply unit is different from the direction in which the screw conveys the toner toward the toner outlet.

11. The cartridge according to claim 1, wherein the air supply unit is provided downstream of the toner outlet in the direction in which the screw conveys the toner toward the toner outlet.

12. The cartridge according to claim 1, further comprising a driving force receiving member configured to receive a driving force from the outside of the cartridge, and wherein the air supply unit and the elastic member are driven by the driving force transmitted from the driving force receiving member.

13. The cartridge according to claim 1, wherein the toner outlet and the air supply unit are provided on an end portion of the toner container on the same side in a longitudinal direction of the toner container.

14. The cartridge according to claim 1, wherein the screw is rotatable with respect to the toner container.

15. An image forming apparatus comprising:

an apparatus container;

a toner container provided with a toner outlet through which toner in the toner container is to be discharged to the apparatus container;

a screw configured to rotate so as to convey the toner toward the toner outlet, the screw being provided in the toner container, an elastic member configured to repeat action of shifting between an entering state in which a part of the elastic member enters the toner outlet and a retraction state in which the part of the elastic member retracts from the toner outlet, the elastic member being attached to a downstream end portion of the screw in a conveyance direction in which the screw conveys the toner toward the toner outlet so as to perform the action by a rotation of the screw; and an air supply unit configured to supply air so as to discharge the toner together with the air, through the toner outlet, from the toner container to the apparatus container, wherein the toner container is provided with an air inlet through which the air supplied by the air supply unit is put into the toner container, the air inlet being provided downstream of the elastic member in the conveyance direction.

16. The image forming apparatus according to claim 15, wherein the elastic member is a sheet.

17. The image forming apparatus according to claim 15, wherein the air supply unit is a pump having an internal space, and wherein the pump is configured to expand and contract to be shifted between a first state and a second state in which the internal space is smaller in volume than the internal space in the first state, the pump being configured to put air of the internal space into the toner container by being shifted from the first state to the second state, thereby discharging the toner in the toner container to the outside of the cartridge through the toner outlet, the pump being configured to take in air into the internal space by being shifted from the second state to the first state.

18. The image forming apparatus according to claim 15, wherein the air supply unit is configured to repeat exhaust and intake, and wherein the elastic member is configured to perform the action of shifting from the retraction state through the entering state to the retraction state again, at least once, between the exhaust and intake of the air supply unit.

19. The image forming apparatus according to claim 15, wherein the apparatus container is provided below the toner container.

* * * * *